US006808178B1

(12) United States Patent
Sovine

(10) Patent No.: US 6,808,178 B1
(45) Date of Patent: Oct. 26, 2004

(54) CLEARING TRAP

(75) Inventor: H. Addison Sovine, Provo, UT (US)

(73) Assignee: Action Target, Inc., Provo, UT (US)

( * ) Notice: Subject to any disclaimer, the term of this patent is extended or adjusted under 35 U.S.C. 154(b) by 506 days.

(21) Appl. No.: 09/650,843

(22) Filed: Aug. 28, 2000

(51) Int. Cl.[7] ..... F41J 1/12
(52) U.S. Cl. ..... 273/410; 89/36.02
(58) Field of Search ..... 273/404, 410, 273/406, 407; 89/36.07, 36.02

(56) References Cited

U.S. PATENT DOCUMENTS

| | | | | |
|---|---|---|---|---|
| 197,398 A | * | 11/1877 | O'Neil | 273/410 |
| 694,581 A | | 3/1902 | Reichlin | |
| 941,642 A | | 11/1909 | Maxim | |
| 2,013,133 A | | 9/1935 | Caswell | |
| 2,411,026 A | | 11/1946 | Conner et al. | |
| 2,420,304 A | | 5/1947 | Diem | |
| 2,613,934 A | * | 10/1952 | Tabler | 273/404 |
| 2,670,959 A | * | 3/1954 | Broyles | 273/410 |
| 3,701,532 A | | 10/1972 | Nikoden | |
| 4,126,311 A | | 11/1978 | Wagoner | |
| 4,445,693 A | | 5/1984 | Angwin | |
| 4,509,301 A | * | 4/1985 | Head | 273/410 |
| 4,787,289 A | * | 11/1988 | Duer | 273/410 |
| 5,121,671 A | | 6/1992 | Coburn | |
| 5,171,020 A | | 12/1992 | Wojcinski | |
| 5,405,673 A | | 4/1995 | Seibert | |
| 5,435,571 A | | 7/1995 | Wojcinski et al. | |
| 5,441,280 A | | 8/1995 | Copius | |
| 5,607,163 A | | 3/1997 | Nesler | |
| 5,811,718 A | | 9/1998 | Bateman | |
| 6,016,735 A | * | 1/2000 | Langner | 273/410 |

FOREIGN PATENT DOCUMENTS

| | | |
|---|---|---|
| WO | 94/27111 | * 11/1994 |

* cited by examiner

*Primary Examiner*—Mark S. Graham
(74) *Attorney, Agent, or Firm*—Bateman IP Law Group

(57) ABSTRACT

A clearing trap for decelerating bullets includes a housing and a bullet decelerating insert disposed within the housing. Preferably, the insert is slidably removable from the housing and is provided with a plurality of vents which help dissipate the force associated with firing a gun into a small enclosure. Also preferably, a portion of the insert is detachable or openable to facilitate periodic cleaning of the insert.

15 Claims, 5 Drawing Sheets

CLEARING TRAP

BACKGROUND OF THE INVENTION

1. Field of the Invention

The present invention relates to a method of decelerating projectiles. More specifically, the present invention relates to an improved clearing trap for decelerating projectiles discharged when performing a clearing check to ensure that the gun is empty.

2. State of the Art

In order to maintain proficiency in the use of firearms, it is common for law enforcement officers and sportsmen to engage in target practice. Participants will typically shoot at targets which are placed before some type of bullet containment system. After passing through the target, the bullet is typically contained in a trap where the bullet may be retrieved and recycled. Such traps include total containment system wherein the bullet is received in a chamber, and less expensive berm traps in which the bullet is received by a bullet deceleration medium.

After a target shooter is finished, it is usually a requirement that he unload the weapon for transportation and/or storage. While it is easy to remove a magazine or other container holding the bullets, it is often difficult to accurately determine if a bullet is contained in the chamber of the gun. Numerous people have been killed or injured when a gun which was believed to be empty discharged.

To prevent such accidents from occurring, it is common for the target shooter to use a clearing trap. A clearing trap is typically a small trap disposed near the main target range into which a gun is inserted and the trigger pulled. If the gun has been properly emptied, there will be no discharge and the user will be assured that the gun is empty. However, occasionally the gun will fire due to a round that was not properly removed from the chamber. Once the round is discharged, the user may pull the trigger again for assurance that the gun is empty. Once it is demonstrated that the gun is empty, the user may store or transport the gun.

While clearing traps are important to prevent accidental discharges, the presently available traps have several disadvantages. For example, in FIG. 1A there is shown a perspective view of a prior art clearing trap, generally indicated at 10. The clearing trap 10 has a cylindrical housing 14 which has a closed lower end 18 and an upper end 22 partially enclosed by a disk with an opening for receiving the barrel of a gun. The cylindrical housing is held at an angle of between about 45 and 70 degrees so that the user may hold the gun in a comfortable position while pulling the trigger.

The cylindrical housing 14 is filled with sand to decelerate rounds which are fired therein. When the housing 14 is sufficiently full of bullets, the housing is turned upside down and the contents removed.

The configuration shown has several disadvantages. For example, the housing 14 must be made either of specially formed steel plate (i.e. steel having a thickness of 0.25 inches), or of standard steel. Forming the steel plate into the cylindrical housing 14 is expensive, and using standard steel raises the risk that the housing will become damaged if a user fires the gun at an angle significantly tangential to the long axis of the housing.

Additionally, cleaning the housing 14 is difficult as the housing must be inverted and the sand and bullets removed. The sand in the housing is heavy, thereby requiring significant strength to lift and invert the housing 14. Also, while the housing 14 is being cleaned, the trap 10 remains out of service.

In FIG. 1B, there is shown a side cross-sectional view of an alternate type of clearing trap, generally indicated at 30. The trap 30 uses a circular containment chamber 34 similar to that disclosed in U.S. Pat. Nos. 5,070,763; 5,113,700; 5,121,671; and 5,486,008. As the bullet moves through from the opening 38 through the circular containment chamber 34, the bullet is forced to travel in a circular pattern. While such movement is highly effective at decelerating the bullet, it also tends to cause lead dust to be released into the air. Additionally, the trap 30 is relatively expensive to make, as plate steel must be formed into the circular pattern and be disposed in a relatively large housing.

FIG. 1C shows yet another trap, generally indicated at 50, which is used for clearing weapons. The trap has a housing 54 with an opening 58 for inserting a gun. Disposed within the housing 54 are a plurality of rubber sheets 60. As the bullet travels through the rubber sheets 60, the bullet is decelerated until it comes to a rest.

While the sheets are effective at stopping the bullet and preventing fragmentation, they also become riddled with holes due to the bullets and begin to fall apart. If used frequently, replacement of the sheets can be relatively expensive.

Thus, there is a need for an improved clearing trap and method for bullet deceleration which provides all of the advantages of prior art clearing traps without the disadvantages of the currently available systems. Such a system should be inexpensive, easy to use, and ensure proper deceleration of bullets which are fired into the trap.

SUMMARY OF THE INVENTION

Thus, it is an object of the present invention to provide a clearing trap which is less expensive than those of the prior art.

It is another object of the present invention to provide such a clearing trap which safety decelerates bullets.

It is still yet another object of the present invention to provide such a clearing trap which is easy to maintain, and has minimal downtime.

The above and other objects of the invention are realized in specific illustrated embodiments of a clearing trap having a housing, a bullet deceleration insert, and a bullet decelerating material disposed within the insert for decelerating bullets fired into the trap.

In accordance with one aspect of the invention, the housing is formed of a conventional grade steel which is preformed in a desired shape (typically of square cross-section). The insert is formed of a plate steel which is sufficiently thick to stop high-power or other predetermined strength rounds. The insert may be slid into the housing for use, and then slid out of the housing when the insert becomes sufficiently full to require emptying. While the insert is being cleaned, another insert can be placed into the housing so that there is virtually no downtime for the clearing trap.

In accordance with another aspect of the invention, the insert is formed from interlocking pieces of plate steel. To empty the insert, one piece must simply be moved relative to another, thereby exposing the contents of the insert and allowing for rapid cleaning and refilling of the insert.

In accordance with still yet another aspect of the invention, the insert is provided with a plurality of vent holes. The vent holes are configured to allow release of a small amount of air from the insert when a gun is fired into the insert—thereby dissipating the energy associated with firing the gun.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1A:
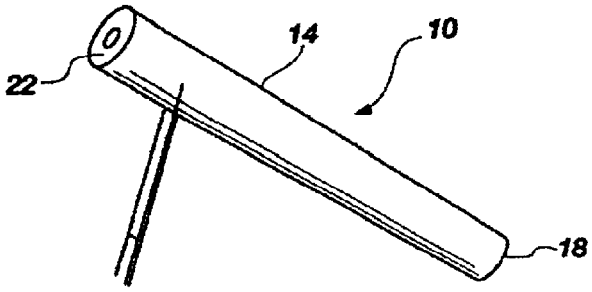
FIG. 1A (PRIOR ART)
FIG. 1A shows a side view of a clearing trap made in accordance with the teachings of the prior art.
Figure 1B:
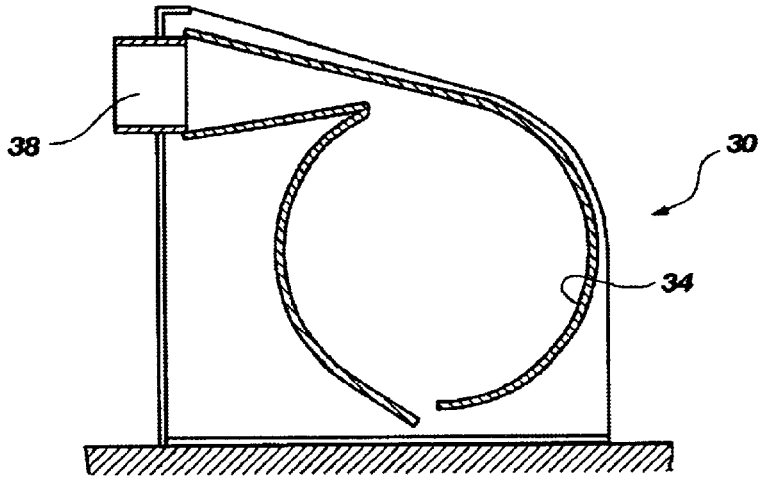
FIG. 1B (PRIOR ART)
FIG. 1B shows a side cross-sectional view of another clearing trap made in accordance with the teachings of the prior art.
Figure 1C:
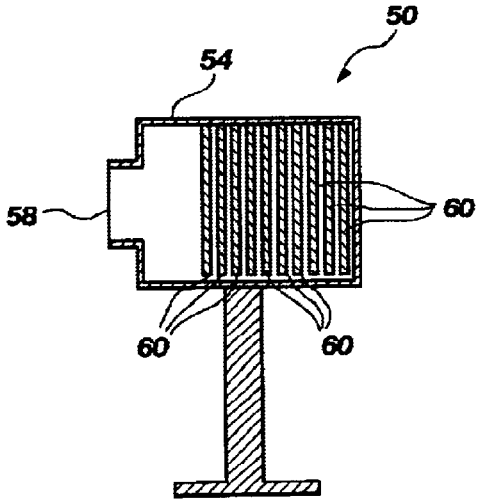
FIG. 1C (PRIOR ART)
FIG. 1C shows a side cross-sectional view of another clearing trap made in accordance with the teachings of the prior art.
Figure 2:
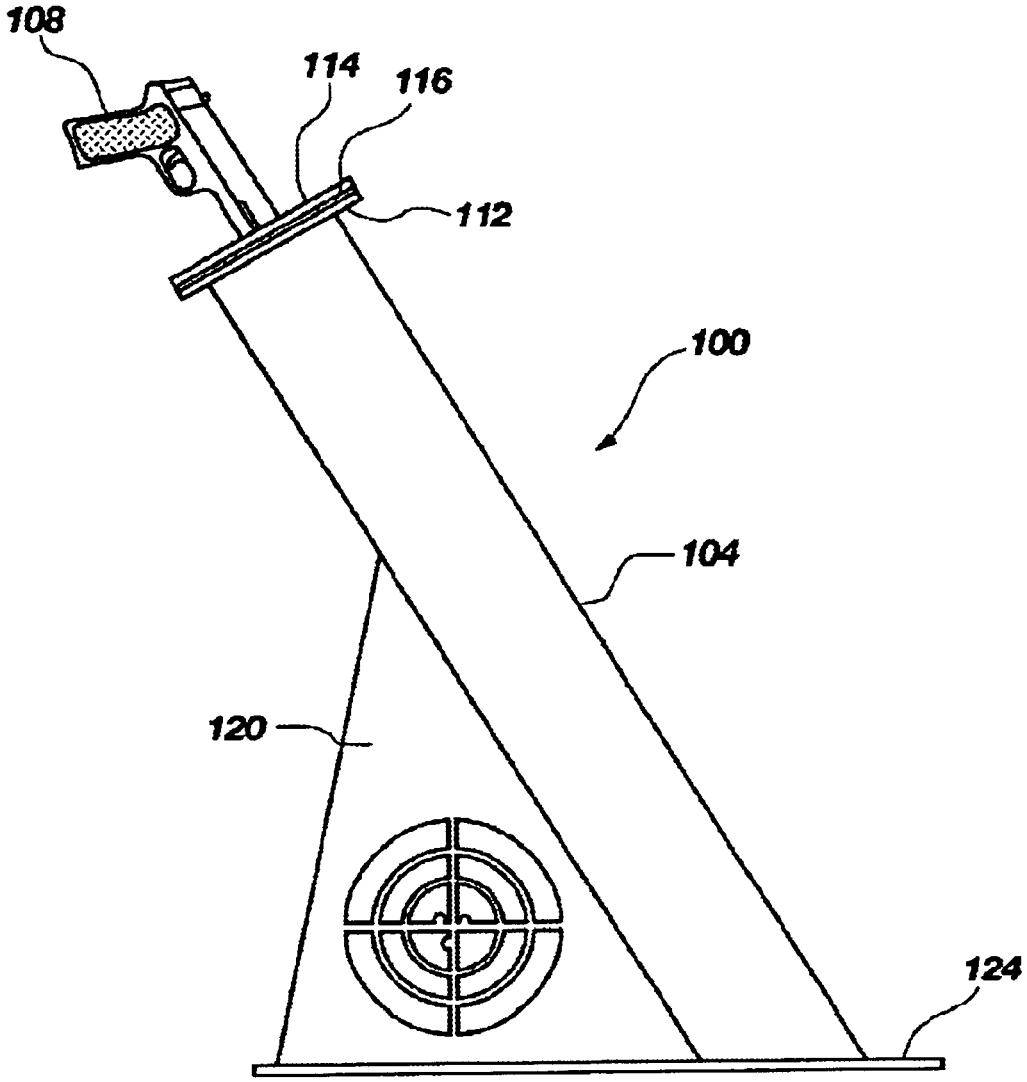
FIG. 2 shows a side view of a clearing trap made in accordance with the principles of the present invention, and a gun inserted into the clearing trap.

FIG. 2 shows a side view of a clearing trap, generally indicated at 100, made in accordance with the principles of the present invention. The clearing trap 100 includes an elongate housing 104 into which a gun 108 is inserted and the trigger pulled in order to ensure that the gun has been properly unloaded. The housing 104 is typically formed by an outer wall surrounding a void.

A pair of flanges 112 and 114 are positioned adjacent the top of the housing 104. The flanges 112 and 114 extend outwardly 104 and hold a rubber shield 116 to form a face plate with an opening for receiving the gun 108. As will be explained in additional detail below, the flanges 112 and 114 can be attached directly to the housing 104 or to an insert (not shown) which nests within the housing.

The housing 104 is preferably made of a tube of conventional steel having a square cross-section. The housing 104 is disposed at an angle of between about 50 and 70 to the horizontal so that the user may maintain a comfortable position when performing the clearing check on the gun 108.

The housing 104 is supported by a leg 120 which prevents the housing from being accidentally pulled toward the user. A base plate 124 is attached to the bottom the housing 104 and the leg 120 to provide lateral stability. For reasons which are discussed in additional detail below, the base plate 124 can be anchored to the floor by bolts or some other securement mechanism if desired.

Figure 3:
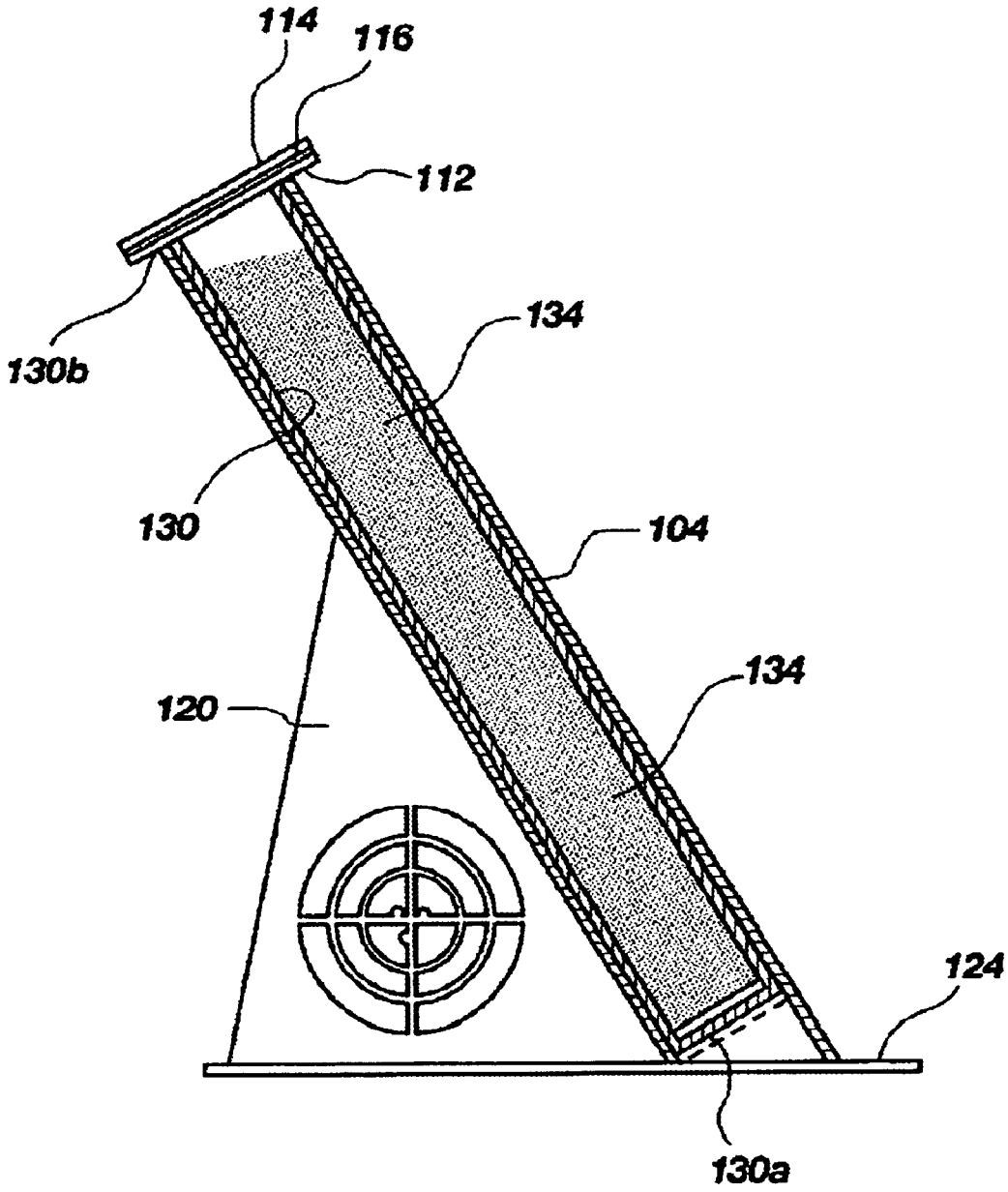
FIG. 3 shows a side cross-sectional view of the clearing trap shown in FIG. 2.

Turning now to FIG. 3, there is shown a cross-sectional view of the housing 104 of FIG. 2. A bullet deceleration insert 130 is disposed in the housing 104 and extends substantially the length thereof. The bullet deceleration insert 130 is preferably slidably removable from the housing 104 by pulling the insert upwardly along the long axis of the housing. While the housing 104 is typically made of steel, it can also be made of other materials, such as plastic, wood, etc. The housing 104 may be made from materials other than those conventionally used for bullet deceleration because the insert 130 is made from steel which is sufficiently hard and thick (i.e 0.25 inch plate steel) to withstand a desired round. Because the insert 130 decelerates the bullet, the housing 104 does not have to withstand a significant amount of force.

As shown in FIG. 3, the insert 130 is filled with a bullet deceleration medium 134, such a chopped pieces of rubber, which preferably decelerates the bullet before it reaches the lower end 130*a* of the insert. At the opposing upper end 130*b*, the insert 130 may be attached to the flanges 112 and 114 and rubber shield 116 forming the face plate so that the flanges 112 and 114 form a stop which limits advancement of the insert into the housing 104. In the alternative, the housing 104 can simply be sized so that the insert 130 can only be advanced a predetermined distance into the housing 104 before being stopped by the base plate 124 or some other obstruction.

While not shown in FIG. 3, the insert may also include a plurality of vents. The vents allow the force produced by firing a round at close range to be more readily dissipated. If any deceleration medium 134 escapes from the insert 130 through the vents, it will simply collect at the bottom of the housing 104 and may be cleaned out at a later time by use of a vacuum, shovel, etc.

Also discussed in detail below with respect to a preferred embodiment of the insert 130 is that one wall of the insert can be removed from the remaining portions to facilitate rapid cleaning of the insert. When such a configuration is used, the removable wall is disposed adjacent the upper sloping sidewall 104*a* of the housing 104. In such a configuration, the upper wall of the insert 130 is unlikely to accidentally open under the weight of the bullet deceleration medium 134 and bullets contained therein.

Figure 4:
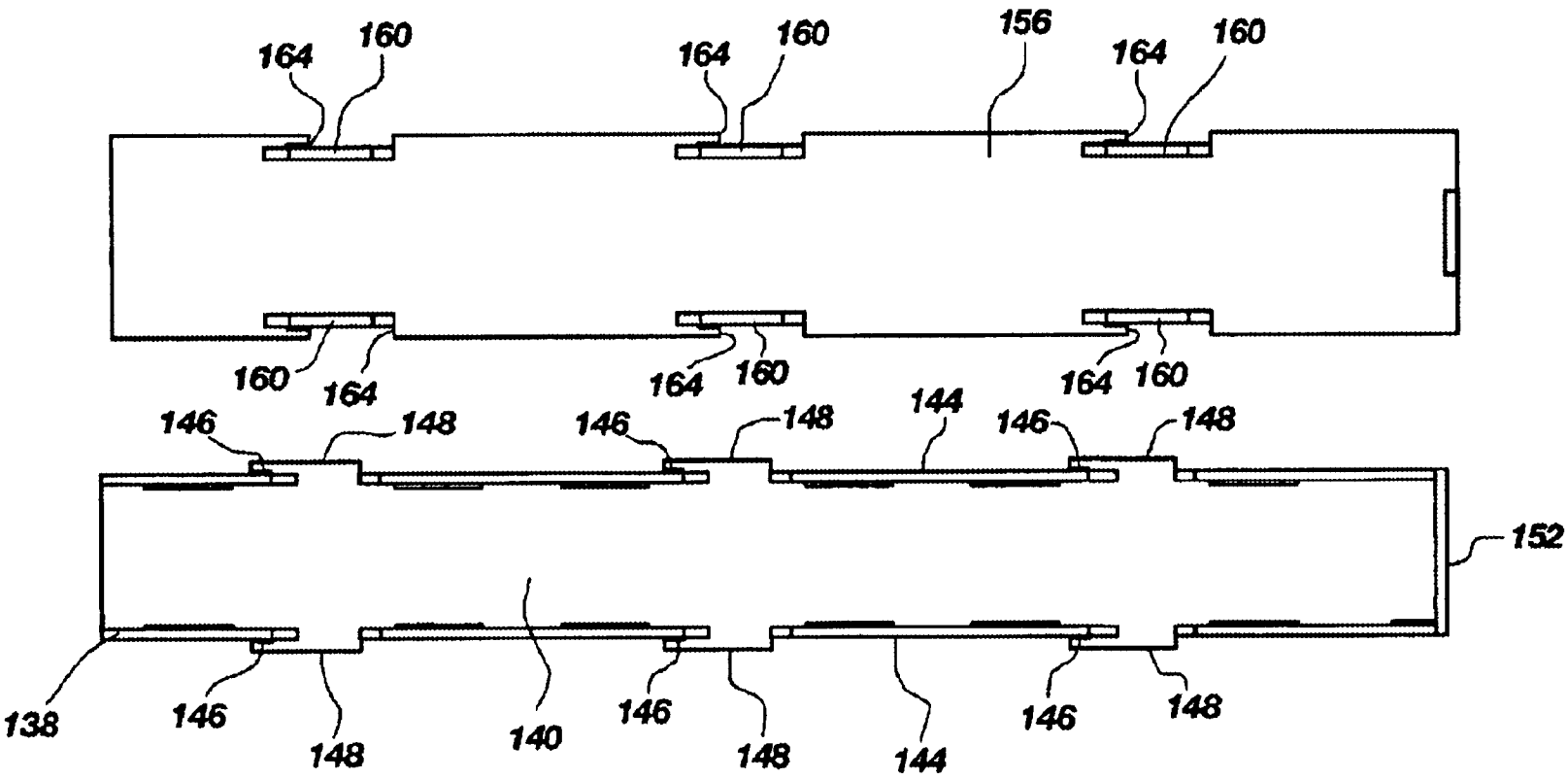
FIG. 4 shows a disassembled top view of a bullet deceleration insert for use in the clearing trap shown in FIGS. 2 and 3.

Turning now to FIG. 4, there is shown a partially disassembled top view of the insert 130. The insert 130 is preferably formed by a bottom portion 138 comprising a bottom wall 140 and a pair of sidewalls 144 attached to the bottom wall so as to form a U-shaped cross-section. Ideally, the sidewalls 144 are connected to the bottom wall 140 by a plurality of interlocking channels 146 and tabs 148. The bottom wall 140 is then welded to the sidewalls 144 to form a three sided container. An end plate 152 is disposed on the lower end 130*a* of the insert 130 and is preferably welded to the bottom wall 140 and the sidewalls 144. The end plate 152 can be formed from a solid piece of plate or, as is explained below, may be formed from overlapping plates with slots which provide vents for the insert 130.

Also shown in FIG. 4 is the top wall 156. Unlike the bottom wall 140 and the sidewalls 144, the top wall 156 is not welded to the remaining portions of the insert 130. Rather, the top wall 156 has tabs 160 and channels 164 which engage the channels 146 and tabs 148 of the sidewalls 144 to facilitate attachment to the bottom portion 138. Preferably, the tabs and channels 146, 148, 160 and 164 engage one another to leave a plurality of small vents along the insert 130. The vents allow a small amount of air to escape the insert 130 to dissipate the force associated with firing a gun into the insert, but are sufficiently small that a bullet could not pass therethrough without obliterating the bullet.

The insert 130 embodiment shown in FIG. 4 is a presently preferred embodiment because, by having the top 156 readily removable from the sidewalls 144, the insert 130 can be opened and cleaned with very little effort. Once returned to its place, however, the top 156 securely engages the sidewalls 144 and the insert 130 forms a highly effective bullet trap. While providing less efficient cleaning, the insert could be formed with all four plates fixedly attached to each other to form a tubular insert closed at the bottom by the end plate 152.

One principle advantage of the configuration of the present invention is that it is generally of lower cost than the prior art. Because the housing 104 does not need to be extremely bullet resistant, off-the-shelf square tubing can be used. While the steel plate necessary to make the insert 130 is generally expensive, the relatively small sizes which are used for the bottom 140, sidewalls 144 and top 156 are readily obtainable from scrap left over from cutting larger pieces of plate for full sized bullet containment traps. Thus, the primary costs associated with the clearing trap 100 are the labor to cut the pieces and weld them together.

Figure 5A:
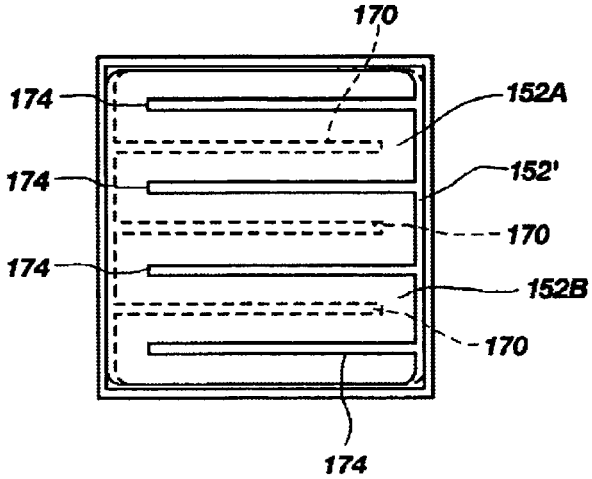
FIG. 5A shows a plan view of a pair of end plates disposed at the end of an insert made in accordance with principles of the present invention.

Turning now to FIG. 5A, there is shown a bottom view an end plate 152' made in accordance with principles of the present invention. While the lower end 130*a* of the insert 130 can be formed by a solid end plate 152 as discussed above, it is preferably formed by a pair of plates. A first plate 152A (which is shown in shadow in FIG. 5A) is configured with three slots 170 therein. A second plate 152B is configured with four slots 174 therein. As shown in FIG. 5A, when the first and second plates 152A and 152B are oriented so that the slots 170 and 174 are parallel, the slots do not overlap. Thus., there is no straight line which a projectile could follow and pass through both the slots 170 in the first plate 152A and the slots 174 in the second plate 152B.

Figure 5B:
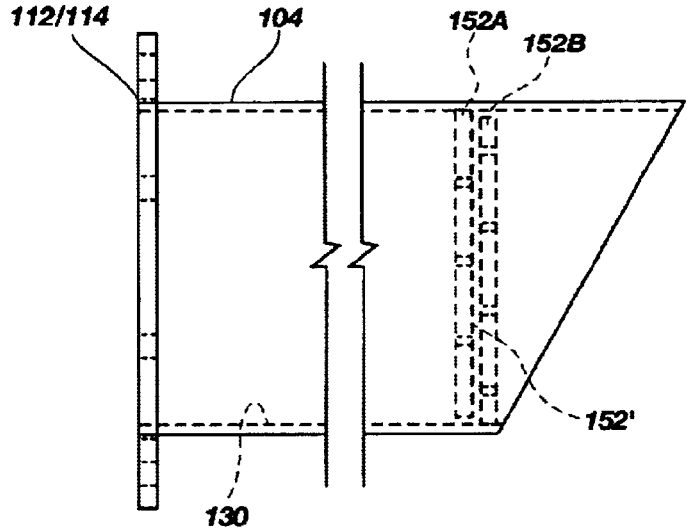
FIG. 5B shows a fragmented side view of the housing, with the orientation of the end plates demonstrated in shadow.

FIG. 5B shows a side view of the housing 104 with the insert 130, including the end plate 152' shown in shadow. Preferably, the first plate 152A and the second plate 152B are also spaced apart slightly when they are welded to the bottom 140 and sidewalls 144. This spacing allows airflow to pass through the slots 170 and 174 while substantially eliminating the probability of a bullet passing through slots. Of course, the narrower the slots 170 and 174, the less the likelihood that a bullet would pass therethrough. Furthermore, it is important to remember that very few bullets will ever reach the end plate 1521 due to the bullet deceleration medium 134 (FIG. 3) disposed in the insert.

While the configuration shown in FIGS. 5A and 5B is a preferably preferred embodiment, the first and second plates is 152A and 152B could be rotated so that the slots 170 and 174 overlap one another, thereby leaving small holes in the bottom plate 152 to allow air flow, yet substantially prevent bullet fragments from passing therethrough.

Figure 6:
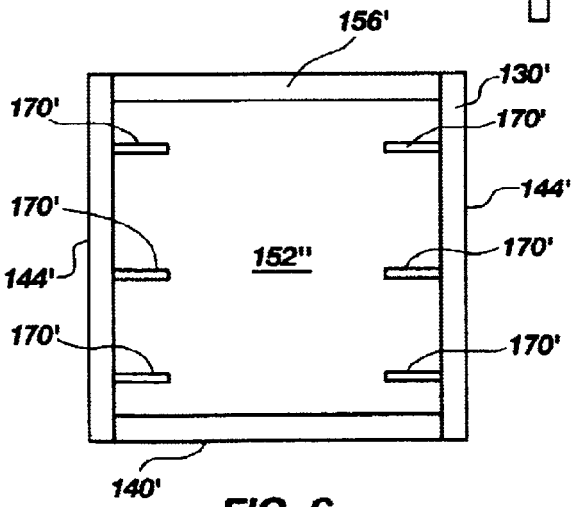
FIG. 6 shows an end view of the bottom wall and sidewalls of an insert with a different end plate configuration attached thereto.

FIG. 6 shows an end view of the bottom wall 140' and sidewalls 144' of an insert 130'. Unlike the insert discussed above, the bottom wall 140', the sidewalls 144', and the top wall 156' are simply welded together. While such a configuration does not provide vents, vents could be provided if desired by either forming grooves into the edges of the bottom wall 140', sidewalls 144' or top wall 156', or by drilling holes in the walls.

Disposed at the far end of the insert 130' is a single end plate 152". The end plate 152" has six small slots 170' formed therein to provide venting of the insert. By providing vents, the force of generated by discharging the gun is dissipated and the risk of the force blowing bullet deceleration medium 134 (FIG. 3) back at the user is minimized.

Thus there is disclosed an improved clearing trap for use with firearms which is inexpensive, easy to construct and to use. While the embodiment shown in FIGS. 2 through 6 are currently preferred embodiments, those skilled in the art will appreciate that numerous modifications can still be made within the principles of the present invention. For example, while a square cross-section is presently preferred for the housing 104 and the insert 130 or 130' because plate pieces of steel plate are readily available, the housing and the insert could be formed with some other cross-sectional geometry. Likewise, those skilled in the art will appreciate that numerous other modifications could be made to the invention with respect to the vents or other aspects of the housing 104 or inserts 130 and 1301. The appended claims are intended to cover such modifications.

What is claimed is:

1. A trap for receiving bullets, the trap comprising:

a housing having a cavity defined by an outerwall surrounding a void; and an insert forming a bullet deceleration chamber, the insert being slidably insertable into and removable from the void of the housing, the insert being formed of a bullet decelerating material and having an opening for receiving a barrel of a gun, wherein the insert is formed by plurality of pieces of steel plate.

2. The trap for receiving bullets according to claim 1, wherein the plurality of pieces of steel plate form a bottom portion having a generally u-shaped cross-section and a top removably engaging the bottom portion such that the insert has a square cross-section when the top is attached.

3. The trap for receiving bullets according to claim 2, wherein the bottom portion is formed by a bottom and a pair of sidewalls, the bottom and sidewalls being fixedly attached to one another.

4. The trap for receiving bullets according to claim 1, wherein the insert comprises a plurality of vents force from the insert when a gun is fired into the insert.

5. The trap for receiving bullets according to claim 4, wherein the insert is formed from a top plate, a bottom plate and a pair of sidewalls, and wherein the vents are formed between the sidewalls and at least one of the top plate and the bottom plate.

6. The trap for receiving bullets according to claim 4, wherein the insert has at least one plate forming a lower end, and wherein the at least one plate has at least one slot formed therein.

7. A trap for receiving bullets, the trap comprising:

a housing having a cavity defined by an outerwall surrounding a void; and an insert forming a bullet deceleration chamber, the insert being slidably insertable into and removable from the void of the housing, and wherein the insert has bottom plates and wherein the bottom plates each have slots formed therein.

8. The trap for receiving bullets according to claim 7, wherein the plates are aligned such that the slots in the plates do not overlap.

9. The trap for receiving bullets according to claim 1, wherein the insert further comprises a bullet deceleration medium disposed therein.

10. The trap for receiving bullets according to claim 9, wherein the bullet deceleration medium is formed by pieces of rubber.

11. The trap of receiving bullets according to claim 1, wherein the housing is formed from a tube having a generally square cross-section.

12. The trap for receiving bullets according to claim 1, wherein the housing is formed from a material other than plate steel.

13. A method for forming a clearing trap, the method comprising:

selecting a housing having a void configured to receive a bullet deceleration chamber and an open end through which a bullet passes;

selecting a bullet deceleration chamber formed from a plurality of generally flat pieces of steel; and sliding the bullet deceleration chamber through the open end and into the void configured to receive the bullet deceleration chamber.

14. The method according to claim 13, wherein the method further comprises forming a face plate at one end of the housing or insert.

15. The method according to claim 13, wherein the method further comprises filling the bullet deceleration chamber with a bullet deceleration medium.

* * * * *